US008267199B2

(12) United States Patent
Buckman, Sr. et al.

(10) Patent No.: US 8,267,199 B2
(45) Date of Patent: Sep. 18, 2012

(54) PERFORATING AND JET DRILLING METHOD AND APPARATUS

(75) Inventors: William G. Buckman, Sr., Bowling Green, KY (US); William C. Maurer, Austin, TX (US); Zachary D. Pearl, Bowling Green, KY (US)

(73) Assignee: Buckman Jet Drilling, Bowling Green, KY (US)

( * ) Notice: Subject to any disclaimer, the term of this patent is extended or adjusted under 35 U.S.C. 154(b) by 0 days.

(21) Appl. No.: 13/237,850

(22) Filed: Sep. 20, 2011

(65) Prior Publication Data

US 2012/0006548 A1 Jan. 12, 2012

Related U.S. Application Data

(62) Division of application No. 12/365,667, filed on Feb. 4, 2009, now Pat. No. 8,196,680.

(51) Int. Cl.
*E21B 7/08* (2006.01)
*E21B 43/114* (2006.01)

(52) U.S. Cl. ..... 175/62; 175/75; 166/298

(58) Field of Classification Search ..... 166/296, 166/55.1, 222, 298; 175/62, 67, 81, 424
See application file for complete search history.

(56) References Cited

U.S. PATENT DOCUMENTS

| | | | | |
|---|---|---|---|---|
| 3,116,800 | A * | 1/1964 | Kammerer | 175/317 |
| 4,256,179 | A * | 3/1981 | Shillander | 166/237 |
| 7,168,491 | B2 * | 1/2007 | Malone et al. | 166/298 |
| 2002/0000318 | A1 * | 1/2002 | Allamon et al. | 166/291 |
| 2007/0044958 | A1 * | 3/2007 | Rytlewski et al. | 166/250.01 |

* cited by examiner

*Primary Examiner* — David Andrews
(74) *Attorney, Agent, or Firm* — John J. Love; Claude E. Cooke, Jr.; Cooke Law Firm

(57) ABSTRACT

Apparatus and method for drilling perforations in well casing and drainholes into a subterranean formation around a well are provided. A tool body on tubing directs a mechanical cutter or jet bit to the casing. A hole is cut in casing and a rotary detent mechanism may be used to drill additional holes through casing to enable alignment of a jet bit with the holes for drilling drainholes without removing apparatus from the well. Disposable nozzles in a guide channel or nozzles on the tool body may be used for drilling through casing.

8 Claims, 5 Drawing Sheets

PERFORATING AND JET DRILLING METHOD AND APPARATUS

This application is a divisional application of U.S. application Ser. No. 12/365,667 filed on Feb. 4, 2009.

BACKGROUND OF INVENTION

1. Field of the Invention

This invention relates to drilling drain holes in the earth. More specifically, apparatus and method are provided for creating a hole in a well casing using a rotary mechanical or nozzle cutter operating through a tool body and then aligning a guide channel in the tool body with the hole in the casing for jet drilling of a lateral drainhole with a jet bit on a flexible tube.

2. Description of Related Art

There has been increasing interest in jet drilling of drainholes around oil or gas wells to enhance the production and injection rate of wells. Proposed methods generally include drilling a hole in the casing of a well and then drilling a drainhole through the hole in the casing. U.S. Pat. No. 5,853,056 discloses placing a tubing in casing with an "elbow" (diverter) at the bottom, inserting a flexible shaft with a ball cutter attached, making a hole through casing with the ball cutter, removing the ball cutter from the well and, without moving the tubing, inserting a flexible hose through the hole to jet drill a drainhole. The tubing may be turned to drill a drainhole in another direction using the same procedure, requiring running the tubing in and out of the well for the ball cutter and for the jet drill. U.S. Pat. No. 6,263,984 discloses placing a diverter attached to tubing in a well, placing a jet bit on flexible tubing, placing the jet bit through the diverter, jet drilling through casing and continuing to jet drill a drainhole into a formation. U.S. Pat. No. 6,668,948 discloses a nozzle for jet drilling. U.S. Pat. No. 6,283,230 discloses a rotating fluid discharge nozzle passing through a diverter and drilling through casing and into a formation. U.S. Pat. No. 7,168,491 discloses a tool for aligning fluid nozzles for drilling holes in the casing or flexible hoses for drilling drainholes by using a spring-loaded plunger that enters an existing perforation and allows alignment for drilling additional holes in the casing or drainholes into a formation.

For a formation at a depth of 5,000 feet, for example, each travel up and down the well with the apparatus on tubing requires about two hours, assuming there are no difficulties. If the apparatus must be removed from the well for each hole in casing and each drainhole, a minimum of about four hours travel or operating time is required for each lateral (drainhole). For six laterals to be jet drilled at the same level in a well, twenty-four hours operating time is required just for the apparatus to be moved up and down the wellbore. Apparatus and method are needed to allow reliable entry of a jet bit into holes in casing, leading to a decrease in the required operating time to drill multiple laterals at the same depth or elevation in a wellbore.

BRIEF SUMMARY OF THE INVENTION

Apparatus and method for creating a hole in a well casing and drilling of a lateral drainhole into the surrounding formation through the hole in the casing are provided. A tool body containing a guide channel is placed on the bottom of a tubing string in the well. In one embodiment a nozzle is provided at the distal end of the guide channel so as to allow jet drilling to form a hole in the casing. The nozzle may be disposable downhole, such that after the hole is drilled in casing a flexible tubing may be placed through the guide channel and the hole in the casing for jet drilling a drainhole without moving the tubing. In another embodiment using a tool body with a guide channel, a rotary detent apparatus in proximity to the bottom of the tubing is used to allow rotary movement of the tubing from a first direction through a selected angle to a second selected direction. The rotary detent apparatus may be plungers or an indexing tool, for example. In a further embodiment, the bottom of the tubing may be fixed in the axial direction while rotary motion is allowed by a swivel. The swivel may include a rotary detent mechanism. In other embodiments employing a tool body having a guide channel, a series of holes through casing at the same depth (axial position) may be drilled by a mechanical cutter, the holes being drilled at known directions with respect to a reference hole by use of a rotary detent mechanism. After all holes in casing are drilled in known directions at a selected depth, the mechanical cutter may be removed from the well, a jet bit on a flexible tubing may be placed in the well and the rotary detent mechanism used to drill a drainhole through each hole in the casing.

In other embodiments, the tool body has a guide channel and one or more flow channels, with a nozzle at the distal end of each flow channel. The direction of flow from the nozzle is in a first radial direction and a guide channel exiting the tool body is in a second radial direction. The guide channel may be temporarily plugged while holes are cut in casing using nozzles on the flow channels. The tool body may then be rotated through a known angle such that the guide channel in the tool body becomes aligned with a hole in the casing in the first radial direction. The angle of rotation may be determined by a rotary detent mechanism such as a plunger or indexing tool. The guide channel may then be unplugged and a jet bit on a flexible tube may then be passed through the guide channel and the hole in the casing and a drainhole may be drilled from the wellbore into the surrounding formation through each hole in the casing.

BRIEF DESCRIPTION OF THE SEVERAL VIEWS OF THE DRAWING(S)

For complete understanding of the present invention and the advantages thereof, reference is now made to the following description taken in conjunction with the accompanying drawings in which like reference number indicate like features.

DETAILED DESCRIPTION OF THE INVENTION

Figures 1, 1A:
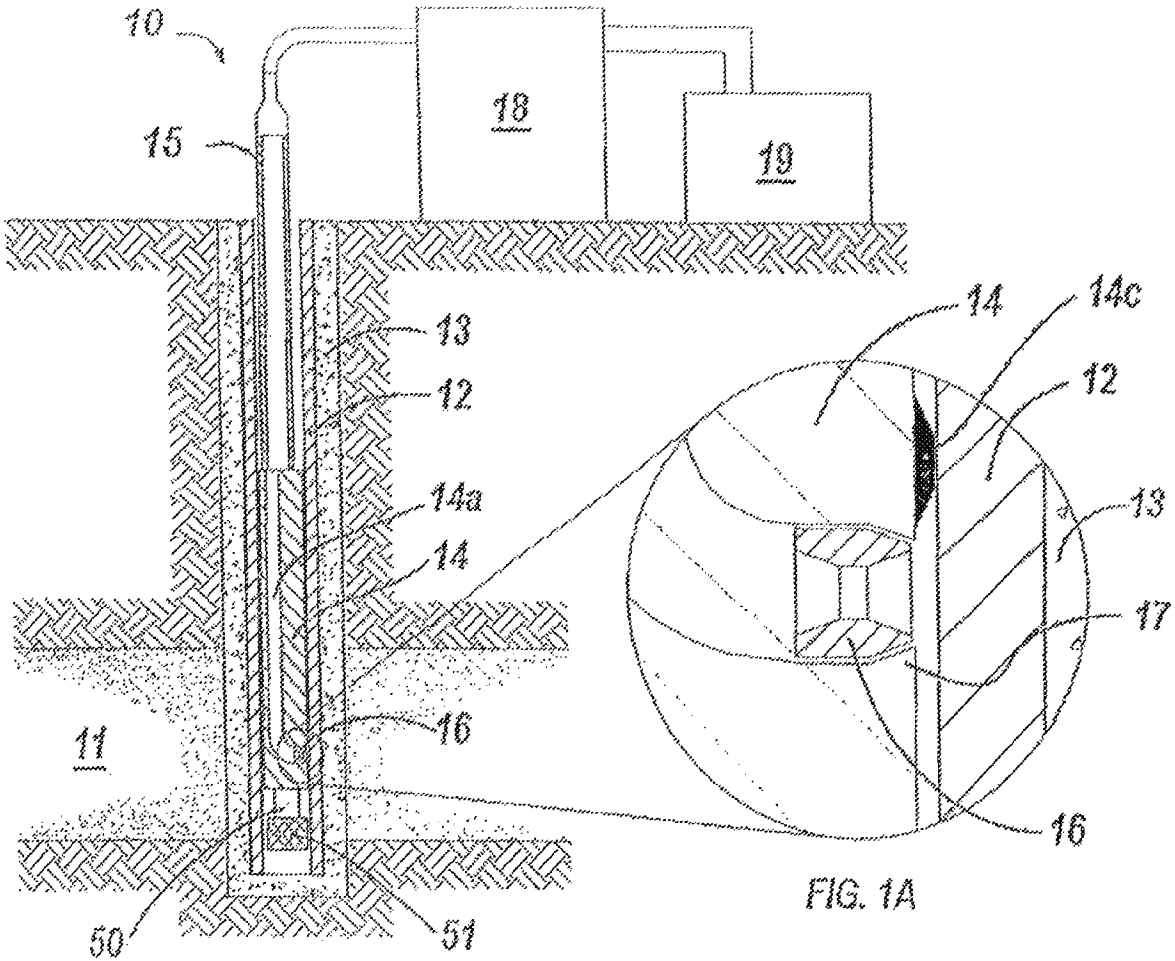
FIG. 1 illustrates apparatus disclosed herein for abrasively cutting a hole in a well casing in a selected radial direction using a nozzle in a guide channel of a tool body.
FIG. 1A is a close-up view of a constriction and a nozzle at the exit of the guide channel.

Referring to FIG. 1, well 10 has been drilled through subterranean formation 11, casing 12 has been placed in the well and cement 13 has been placed outside the casing in the wellbore. Tool body 14, attached to the bottom of tubing 15, and has been lowered through the casing to a selected location adjacent to formation 11. Tool body 14 has guide channel 14*a* therethrough. The diameter of guide channel 14*a* is normally in the range from about 0.5 inch to about 2 inches. In one embodiment, illustrated in FIG. 1, guide channel 14*a* acts as a conduit to enable fluid to flow from the bottom of tubing 15 to nozzle 16. Guide channel 14*a* normally includes a 90-degree turn, preferably with a turn radius of about 9 inches or less, but any turn so as to guide fluid or a tube to the wall of casing 12 may be used. As shown in a close-up view in FIG. 1A, the outlet of the guide channel 14*a* may include a constriction (decreased diameter) 17 to retain perforation nozzle 16 at the distal end of guide channel 14*a*. Perforation nozzle 16 may be a nozzle disclosed in U.S. Pat. No. 6,668,948 or any other nozzle suitable for this application. All orifices of the nozzle preferably have working surfaces made of an abrasion-resistant material, such as tungsten carbide, diamond or alumina. The clearance provided between tool body 14 and casing 12 by standoff button 14*c* may allow improved recovery of solids from a drain hole as it is being drilled into formation 11. Standoff button 14*c* may also be beneficial when jet drilling through a hole in casing 12. The clearance provided is preferably in the range from about ⅛ inch to about ½ inch.

To perforate casing 12 at a selected first location, tool body 14 is attached to tubing 12 and the tubing is run into the well. Nozzle 16 may be attached to the end of guide channel 14*a* before placing the tool body in the well, such as by a threaded connection, or nozzle 16 may be sized to be placed into tubing 15 and slide through guide channel 14*a* into constriction 17. Fluid may be pumped into tubing 15 to assist in placement of the nozzle. The (azimuthal) direction of the nozzle after it is placed in the well, i.e., the radial direction that the nozzle will direct fluids to drill a hole, may be measured by gyroscopic methods well known in industry.

In one embodiment, nozzle 16 is disposable downhole. Abrasion-resistant material in the nozzle may be mounted in a polymer or soft metal matrix such that the nozzle may be drilled by a mechanical or jet drill, may be dissolved by chemical dissolution or may contain a degradable polymer such as disclosed in U.S. Pat. Pub. No. 2004/0231845, which is hereby incorporated by reference herein in its entirety. The degradable polymer, which degrades by hydrolysis of the polymer, may be selected to degrade in mechanical properties in the well fluids in a selected time such that the nozzle can deform and flow from constriction 17 or from threads attaching the nozzle to the distal end of guide channel 14*a*. Alternatively, the nozzle may be made up of small parts that do not degrade but that are held together by a dissolvable or degradable material that degrades and releases the small parts. The small parts of the nozzle are selected to be small enough to pass through constriction 17 or from threads attaching the nozzle to the distal end of guide channel 14*a* and between tool body 14 and casing 12. In either embodiment, the resulting remnants of nozzle 16 may then be pumped or expelled from the end of guide channel 14*a*.

After nozzle 16 is placed in the selected location and selected radial direction in casing 12, pump 18 may pump fluid from tank 19 through the nozzle. The fluid preferably contains abrasive particles, such as sand or ceramic particles. The fluid may be water containing a low concentration of polymer to reduce friction, as is well known in the art, and about 1 pound of silica sand per gallon of fluid, for example. Pump 18 preferably provides pressures between about 2,500 psi and 6,000 psi and flow rates in the range from about 15 gpm to 80 gpm, depending on the size and design of nozzle 16. Typically, the front orifice of nozzle 16 ranges from about 0.060 inch to about 0.250 inch in diameter. When operating pump 18 was operated at about 4,000 psi, using a nozzle such as disclosed in U.S. Pat. No. 6,668,948 with a front orifice diameter of about 0.1 inch and with a flow rate of about 20 gpm, a steel casing and cement sheath were perforated in a matter of minutes.

Preferably, a flush liquid, such as a 2 per cent KCl solution, is pumped ahead of the fluid containing abrasive particles, to insure that the nozzles are open, and after the fluid containing abrasive particles to clean the hole of particles. Slugs of gas, such as nitrogen, may be injected down the tubing along with the liquid to provide a higher drilling rate and to lower the wellbore pressure and allow lower overbalance pressure or underbalanced drilling. Alternatively, foam, a fluid known in industry as a drilling fluid, may be used.

It is well known in industry that when pressure is applied to tubing or the temperature of the tubing changes, the tubing will change its length if it is not fixed at the bottom. This will cause a nozzle fixed to the tubing to move within casing 12. To eliminate or minimize movement, tubing anchor 51 (FIG. 1) may be attached to the lower end of tool body 14 or any other tools in the casing. In one embodiment, tubing anchor 51 may be a tool having hydraulic buttons on the tool, such that when pressure is applied to tubing 15 and guide channel 14*a*, tool body 14 is held rigidly in place. Tubing anchor 51 may be placed above tool body 14. Hydraulic anchors, such as disclosed in U.S. Pat. No. 2,743,781, are commonly used in the oil/gas industry. Upon reducing the pressure, the hydraulic buttons are spring-activated to retract into the tool. In another embodiment, a tubing anchor set by motion of the tubing or hydraulic pressure, as commonly known in industry, may be attached below tool body 14. A suitable tubing anchor is Model C-1 sold by TechWest, Inc. of Calgary, Canada. In embodiments using a tubing anchor, a swivel or indexing tool 50 may be placed between tubing anchor 51 and tool body 14. A suitable swivel is 20-027, sold by TechWest. The swivel may contain a rotary detent mechanism, using well-known mechanisms for rotary detent. The swivel allows tubing 15 to be rotated at the surface for forming a second or subsequent hole at the same axial position. A rotary detent mechanism allows rotation of the tubing a selected angle before forming a second or subsequent hole. In one embodiment, the rotary detent mechanism is an indexing tool that is activated by raising and lowering of tubing 15. A suitable indexing tool is described in U.S. Pat. No. 4,256,179, which is hereby incorporated by reference herein.

Figure 2C:
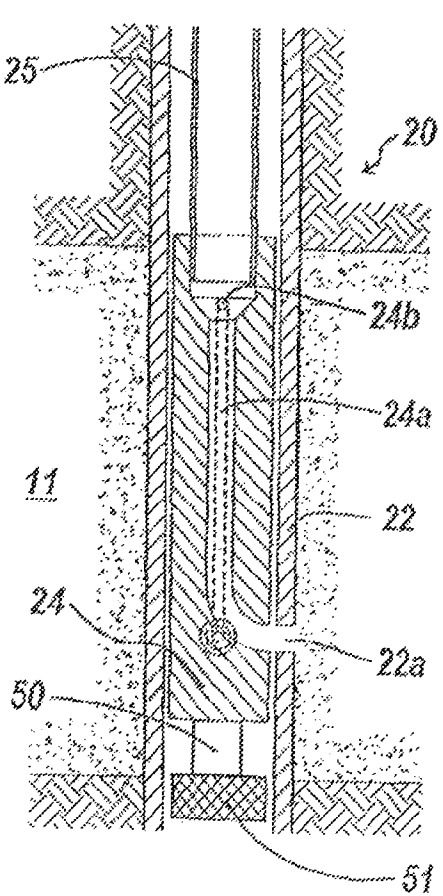
FIG. 2C illustrates a cross-sectional view in a direction orthogonal to the view of FIG. 2B.
Figure 2B:
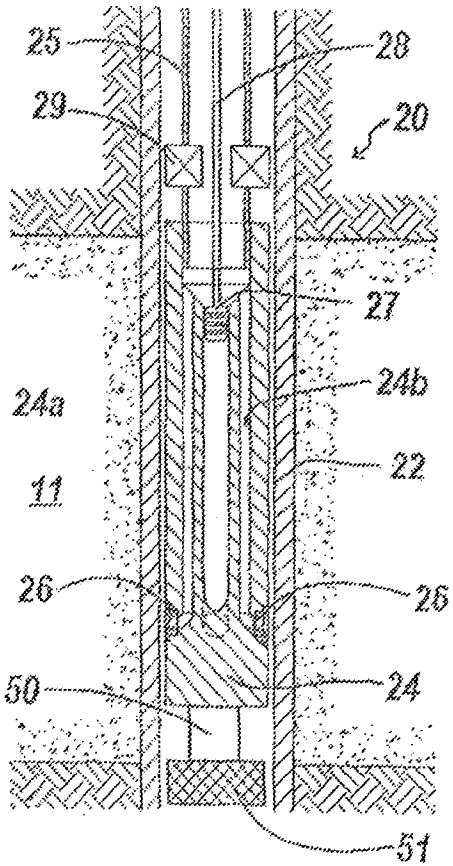
FIG. 2B illustrates a cross-sectional view of the guide channel blocked by a plug to divert fluid to the flow channels.
Figure 2A:
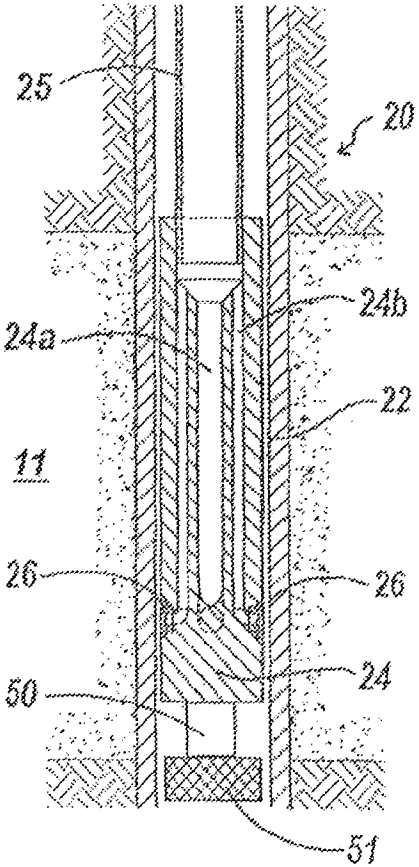
FIG. 2A illustrates a cross-sectional view of two flow channels and abrasive nozzles in the tool body along with a guide channel through the body.

In another embodiment, apparatus illustrated in FIGS. 2A, 2B and 2C is employed to form a hole or holes in a well casing of well 20 at a selected depth. Tool body 24 is placed on tubing 25 and lowered to a location adjacent to formation 11. Tool body 24 contains guide channel 24*a* and one or more flow channels 24*b*. The distal end of flow channel(s) 24*b* leads to nozzle(s) 26 that is at the same axial location as the outlet of the guide channel 24*a*. Preferably, the distal ends of two flow channels are directed in opposite directions. Nozzle 26 preferably has abrasion-resistant surfaces where fluid pumped through the nozzle contacts the surfaces. Tool body 24 may be anchored by anchor 51, as explained above. Rotary detent mechanism 50, which may be part of a swivel or an indexing device, may be placed between anchor 51 and tool body 24. Alternatively, tubing 25 may contain hydraulic buttons or have a hydraulic anchor 29 attached in a way that prevents vertical movement of the tool body 24 during the pumping process.

As illustrated in FIG. 2B, the inlet to guide channel 24*a* may be sealed by plug 27. Plug 27 may be put in place by wire line 28 or may be pumped down tubing 25 to seal on a seat in guide channel 24*a*. Plug 27 may be a ball. The ball may be deformable such that it will pass through the guide channel at higher pressure. With plug 27 in place, casing may be perforated by nozzle(s) 26. Abrasive slurry pumped through tubing 25 into tool body 24 and diverted to flow channel(s) 24*b* and nozzle(s) 26 may be used to cut a hole or holes in casing 12 in a selected first radial direction, as described above. Tool body 24 may then be rotated or indexed to move nozzle(s) 26 to a second selected radial direction, using rotary detent mechanism 50, and abrasive fluid may be pumped again to create another hole or set of holes in casing 12. This process may be repeated until the desired number of holes in different radial directions is obtained. Plug 27 may then be removed by increasing pressure in the tubing to force the plug through its seat, by slick line 28, or by allowing degradation of a degradable polymer, such as discussed above.

FIG. 2C illustrates the apparatus after it has been rotated 90 degrees, preferably using a rotary detent mechanism to determine the proper direction of the apparatus, and plug 27 has been removed. Hole 22*a* has been formed in casing 22 before the tool was rotated. Jet drilling through hole 22*a* into formation 11 may then be performed as discussed below.

Figure 3:
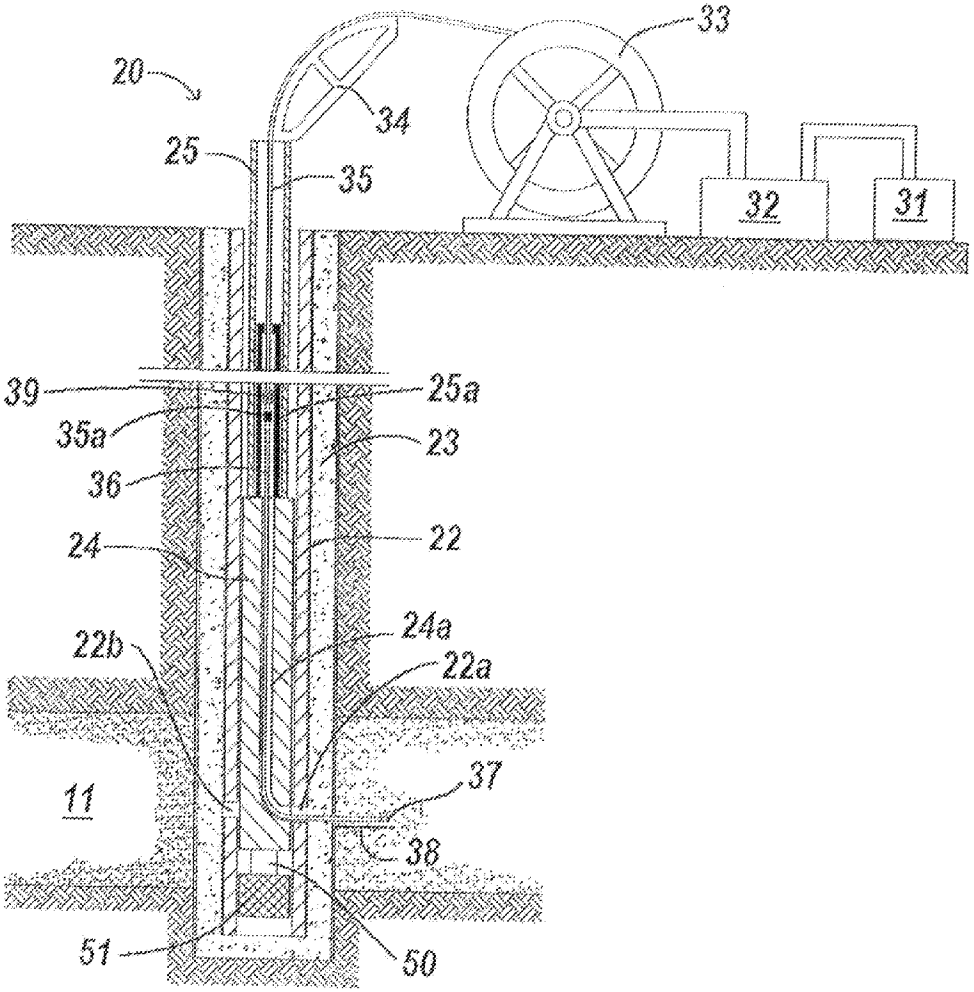
FIG. 3 illustrates one embodiment of surface and downhole apparatus for jet drilling through a hole in casing.

FIG. 3 illustrates one embodiment of apparatus for jet drilling into formation 11. Fluid from tank 31, which may be a liquid containing abrasive particles, friction reducers, surfactants, acidic fluid, corrosion inhibitors or other additives used for drilling, is pumped by pump 32 into reel 33, which contains coiled tubing 35, guided by horsehead 34. Coiled tubing 35 is joined to flexible hose 36 by connector 35*a*, which may be a screw connector. Coiled tubing 35 may be constructed of steel, braided hose or other high-pressure hose. Flexible hose 36 may have a bend radius as small as about 2 inches. Jet bit 37 is joined to the distal end of flexible hose 36. Fluid from tank 31 may then be pressurized to produce fluid flow through jet bit 37 to drill lateral drainhole 38. After drilling drainhole 38, jet bit 37 and flexible hose 36 may then be retrieved into tool body 24 or removed from tubing 25 at the surface. Tubing 25 may then be turned at the surface to rotate tool body 24 through a desired angle of rotation to allow access to another hole in the casing at the same axial position, such as hole 22*b*. Alternatively, the procedure discussed above and illustrated in FIG. 2 may be repeated to add additional holes in casing 22 at the same axial location or at different axial locations. Gas, such as nitrogen, may be injected down the annulus outside coiled tubing 35 to lower pumping pressure and pressure in the wellbore and allow lower overbalance or underbalanced drilling.

Vibrator 39 may be placed at a selected location between pump 32 and bit 37. FIG. 3 shows vibrator 39 in coiled tubing 35, just above connector 35*a*. Vibrator 39 may also be placed near bit 37, for example. Vibrator 39 may be powered by flow, periodically partially closing the flow channel through the vibrator to create pressure variations in the fluid, or may be powered by electrical or hydraulic power from the surface. The pressure variations in the fluid may cause variations in length of flexible hose 36, which may cause a vibrating effect at bit 37. Vibrations may decrease frictional drag of flexible hose on a borehole and allow drilling of drainholes farther into the earth. Also, vibrations at bit 37 may increase drilling rate of the bit.

Sheath 25*a* may be installed onto flexible hose 36 at the surface to rest on connector 35*a* while the hose and bit are being run into the well. Sheath 25*a* acts as a centralizer such that the bit does not catch on tubing collars. Sheath 25*a* lands on top of the tool body 24 to assure that the jet bit enters the diverter at the middle of guide channel 24*a* of tool body 24. Preferably, sheath 25*a* is longer than flexible hose 36 and of such a size that connector 35*a* can readily pass through the inside diameter of sheath 25*a*. Sheath 25*a* prevents folding or coiling of flexible hose 36 and enables coil tubing 35 above flexible hose 36 to apply a force onto the top of the hose to enable the jet bit and flex hose to more readily make the sharp turn in the diverter and to jet drill the formation faster. For example, sheath 25*a* may be 32 feet long with an inner diameter of 1.25 inches. Flexible hose 36 may have an outer diameter of about 0.5 inch and be less than 32 feet long. A vibrator may be used in all embodiments employing a jet bit to drill a drainhole.

Figure 3A:
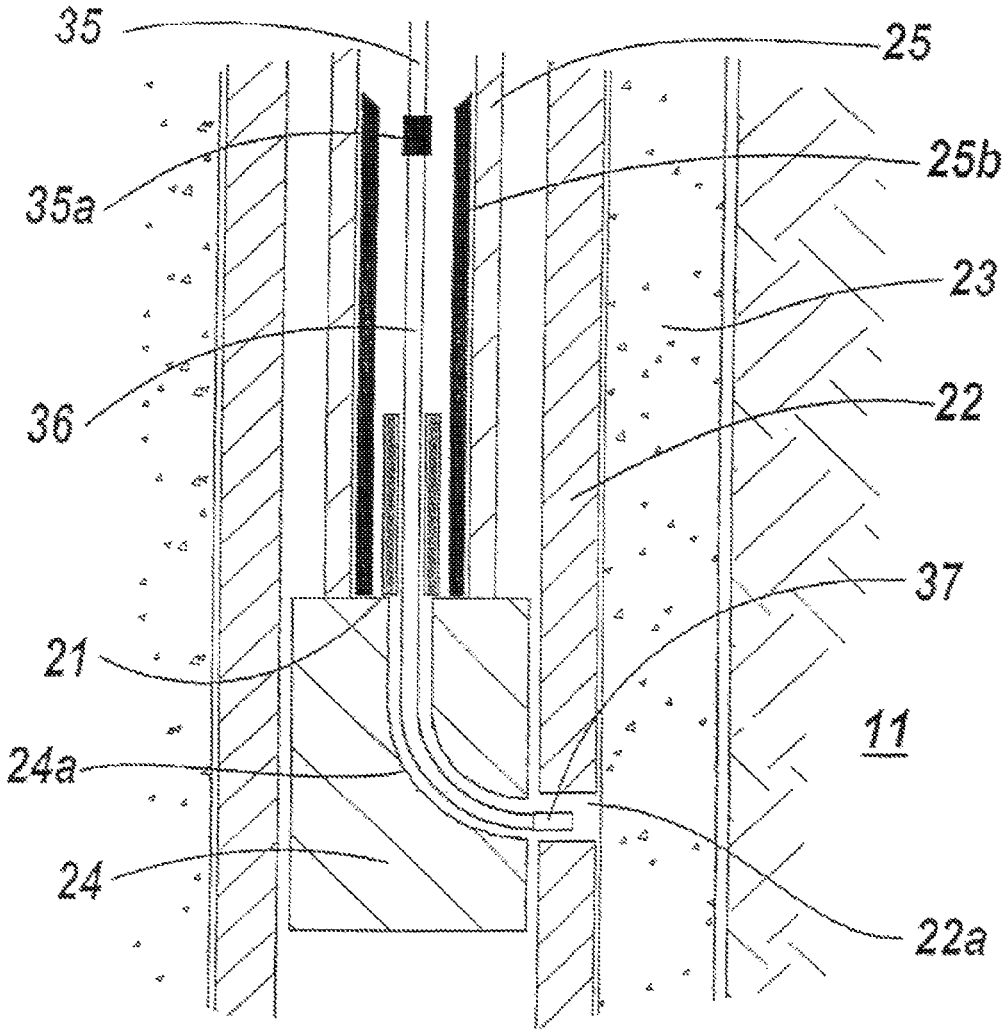
FIG. 3A illustrates another embodiment of surface and downhole apparatus for jet drilling through a hole in casing.

FIG. 3A illustrates centralizing weight tube 21, which may be installed onto flexible hose 36, resting on bit 37, before the hose and bit are run into a well. Weight tube 21 may, for example, have an inner diameter of about 0.6 inch, an outer diameter of about 1.1 inches and a length of about 2 feet. The weight tube acts as a centralizer, such that bit 37 is less likely to catch on tubing collars. In the embodiment shown in FIG. 3A, tubing guide 25*b* is installed with tubing 25 and tool body 24 when the tubing and equipment are run into a well. Tubing guide 25*b* may be attached, such as by welding, inside each joint of tubing 25. Suitable inside diameters of tubing guide 25*b* are, for example, between 1 inch and 1.75 inches. Tubing guide 25*b* helps prevent folding of flexible hose in the tubing, as explained above for sheath 25*a*.

Figure 4B:
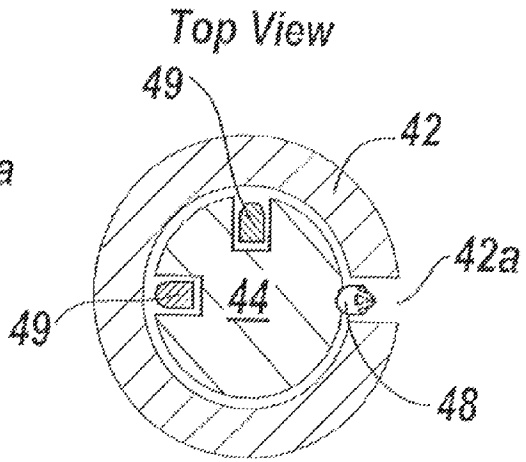
FIG. 4B illustrates a top view of the mechanical cutter after having cut a hole in casing and two plungers in the tool body used in a rotary detent mechanism.
Figure 4A:
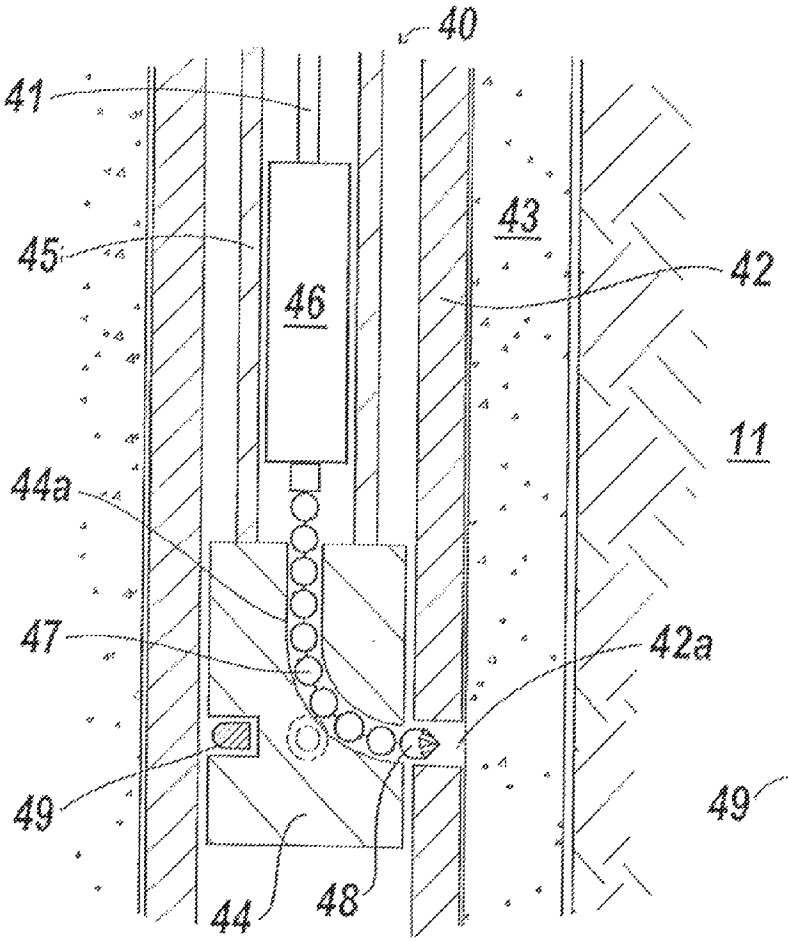
FIG. 4A illustrates a cross-sectional view of a tool body and apparatus for using a mechanical cutter for drilling a hole in the casing and a plunger used as a rotary detent mechanism.

In another embodiment, shown in FIG. 4A, tool body 44 may be used with a mechanical cutter method, as disclosed in U.S. Pats. Nos. 5,853,056; 6,578,636; 6,378,629 and 5,295,544, which are hereby incorporated by reference herein in their entirety. Using a mechanical cutter, tool body 44 is lowered on tubing 45 into well 40 such that the distal end of guide path 44*a* is at the selected depth in the well. A rotary mechanical cutter 48, which may be a ball cutter, hole punch, hole saw or a combination of such, is attached to shaft 47, which is driven by motor 46, which can be a mud motor or an electric motor. The equipment is lowered inside tubing 25 until the motor and cutter are engaged with tool body 44 and shaft 47 is inside guide channel 44*a*. Rotary mechanical cutter 48 is directed by guide channel 44*a* to intercept casing 42 to cut the first window. For an open hole well, the cutter would cut into formation 11. The mechanical cutter may then be retrieved back into tool body 44 and the tool body rotated to its next radial direction. The mechanical cutter may then be used again to create another window or hole at the same axial location in the casing. This process may be repeated until the desired number of windows is created. An advantage to this mechanical cutting method is that an abrasive pump with abrasive fluid tanks and a tubing anchor may not be required, because pressuring the tubing, which may cause the bottom of the tubing to change axial position in the well, is not required if the holes are cut with a mechanical cutter. After the windows or holes are cut in the casing, the jet drilling apparatus and method described above may then used to jet drill the lateral drain holes.

Consider an embodiment in which a mechanical cutter is used to cut four holes at one level in a casing and four laterals are jet drilled at that level with a rotary detent mechanism to determine the location of holes in the casing. FIG. 4A illustrates an apparatus employing rotary mechanical cutter 48 to cut hole 42*a* in casing 42 at a given vertical depth. This apparatus consists of tubing 45 connected to tool body 44 that has guide channel 44*a* with the exit directed toward casing 42. A pump at the surface of well 40 is connected to coil tubing 41 which in turn is connected to motor 46, which in turn is connected to rotary mechanical cutter 48 by flex shaft 47. As the pump pressure causes liquid to flow through motor 46, motor 46 turns flex shaft 47 and rotary mechanical cutter 48. With rotary mechanical cutter 48 being in contact with the casing 42, hole 42*a* is formed in casing 42. The hole may extend a short distance into formation 11. Plunger 49, the rotary detent mechanism in this embodiment, is located at the same level on tool body 44 as the exit of guide channel 44*a* and in a direction 90 degrees from the guide channel. Two plungers are illustrated. Plungers are described in detail in U.S. Pat. No. 7,168,491, which is hereby incorporated by reference herein in its entirety. Tubing 45 must be turned 90 degrees at the top of the well 40 for plunger 49 to be aligned with hole 42*a* in casing 42, where the outlet of the guide channel 44*a* was before turning. FIG. 4B is a plan view showing the angular directions of the two plungers and the hole cut in the casing. Once hole 42*a* has been drilled in casing 42, by turning tubing 45 and tool body 44 through 90 degrees spring-loaded plunger 49 engages into the hole 42*a*. The force on the plunger to cause it to lock into perforation hole 42*a* may be supplied by a spring, by hydraulic pressure or any by other method to exert a force on plunger 49. The angle between plunger 49 and guide channel 44*a* may be adjusted to obtain a different number of holes at each axial location. For example, the angle may be 45 degrees instead of 90 degrees. Preferably, the angle, when divided into 360 is an integer.

The above process can be repeated until all the desired holes are drilled in the casing at a selected depth, just by retrieving rotary mechanical cutter 48 back into tool body 44 for rotating tubing 45. After all holes are drilled at the selected depth, motor 46, flex shaft 47 and rotary mechanical cutter 48 are retrieved from well 40. A flexible hose and jet drill bit are then attached to the coil tubing 41 and a first lateral is drilled through one of the holes 42*a* in the casing 42 and into the formation 11, as described above. After the first lateral is drilled, the flex hose and bit may be retrieved back into tool body 44, the tool body may then be turned 90 degrees, or the angle between rotary detent positions, and then the second lateral may be drilled. This relatively rapid process may be repeated until all laterals are drilled. Then the flexible hose and jet drill bit are retrieved to the surface. The total number of laterals at an axial location is limited only by spacing of holes in the casing. A common number of such laterals is four.

Although the present invention has been described with respect to specific details, it is not intended that such details should be regarded as limitations on the scope of the invention, except to the extent that they are included in the accompanying claims.

We claim:

1. A method for forming a plurality of holes in a casing in a well at a selected axial location and drilling a plurality of drainholes through the holes in the casing and into a subterranean formation, comprising:

(a) attaching a tool body to tubing, the tool body having a guide channel having a proximate end and a distal end, the distal end being directed in a first selected radial direction, and at least one flow channel having a proximate end and a distal end, the distal end being directed in a second selected radial direction spaced apart from the first radial direction and having a nozzle attached thereto;

(b) attaching a rotary detent mechanism to the tool body or the tubing string;

(c) placing the tubing in the well to form a tubing string such that the guide channel is directed to the casing at a first selected depth in the well;

(d) placing a temporary plug in the guide channel to divert fluid to the flow channel;

(e) pumping a fluid through the flow channel and the nozzle attached thereto to form a first hole in the casing;

(f) turning the tubing string from a first to a second stop on the rotary detent mechanism, the radial direction of the stops being spaced apart an amount equal to the spaced apart radial directions of the distal ends of the guide channel and the flow channel of the tool body;

(g) pumping a fluid through the flow channel and the nozzle attached thereto to form a second hole in the casing;

(h) repeating steps (f) and (g) sequentially until a selected number of holes is drilled in the casing at selected stops on the rotary detent mechanism;

(i) removing the temporary plug in the guide channel after the selected number of holes is drilled in the casing and then placing a coiled tubing inside the tubing string, the coiled tubing having attached thereto a flexible hose, the flexible hose having a minimum bend radius of about 2 inches or more and having attached thereto a nozzle adapted for jet drilling;

(j) placing the flexible hose through a hole in the casing at a first selected stop on the rotary detent mechanism and pumping fluid at a selected rate through the jet bit for a selected time so as to jet drill a drain hole into the subterranean formation;

(k) withdrawing the flexible hose into the tool body;

(l) turning the tubing string from the first selected stop to a second selected stop on the rotary detent mechanism;

(m) placing the flexible hose through a hole in the casing at the second selected stop on the rotary detent mechanism and pumping fluid at a selected rate through the jet bit for a selected time so as to jet drill a drain hole into the subterranean formation; and (n) repeating steps (k) though (m) sequentially until a selected number of drainholes is drilled; and (o) removing the coiled tubing and attached apparatus from the well.

2. The method of claim 1 further comprising the step of placing an anchor on the tubing before placing the tubing in the well and attaching the anchor to the casing after placing the tubing in the well.

3. The method of claim 1 wherein the temporary plug in the guide channel is removed by dissolving or degrading.

4. The method of claim 1 wherein the temporary plug in the guide channel is removed by drilling.

5. The method of claim 1 wherein two flow channels, each having distal ends, are directed oppositely and are oriented at 90 degrees with respect to the distal end of the guide channel.

6. The method of claim 1 further comprising moving the tool body such that the guide channel is directed to the casing at a second selected depth in the well and repeating steps (c) through (o).

7. The method of claim 1 further including the step of attaching a tubing anchor to the rotary detent mechanism.

8. The method of claim 7 wherein the rotary detent mechanism is an indexing tool.

* * * * *